US009004182B2

(12) United States Patent
O'Connor et al.

(10) Patent No.: US 9,004,182 B2
(45) Date of Patent: Apr. 14, 2015

(54) EXPANDABLE DOWNHOLE ACTUATOR, METHOD OF MAKING AND METHOD OF ACTUATING

(75) Inventors: Keven O'Connor, Houston, TX (US); Mark K. Adam, Houston, TX (US); Jeffrey C. Williams, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 477 days.

(21) Appl. No.: 12/031,758

(22) Filed: Feb. 15, 2008

(65) Prior Publication Data

US 2009/0205840 A1 Aug. 20, 2009

(51) Int. Cl.

| | |
|---|---|
| ***E21B 43/10*** | (2006.01) |
| ***E21B 23/00*** | (2006.01) |
| ***E21B 23/06*** | (2006.01) |
| ***E21B 33/12*** | (2006.01) |

(52) U.S. Cl.

CPC ..... *E21B 43/103* (2013.01); *Y10T 29/496* (2015.01); *E21B 23/00* (2013.01); *E21B 23/06* (2013.01); *E21B 33/12* (2013.01)

(58) Field of Classification Search

CPC ..... E21B 23/00; E21B 23/06; E21B 43/106; E21B 43/10; E21B 33/10; E21B 43/105

USPC ..... 166/381, 217, 378, 208, 206

See application file for complete search history.

(56) References Cited

U.S. PATENT DOCUMENTS

| | | | | |
|---|---|---|---|---|
| 4,936,386 | A | 6/1990 | Colangelo | |
| 5,901,789 | A | 5/1999 | Donnelly et al. | |
| 6,540,777 | B2 * | 4/2003 | Stenzel | 623/1.16 |
| 6,695,067 | B2 | 2/2004 | Johnson et al. | |
| 6,705,615 | B2 | 3/2004 | Milberger et al. | |
| 6,712,154 | B2 | 3/2004 | Cook et al. | |
| 6,854,522 | B2 | 2/2005 | Brezinski et al. | |
| 6,935,432 | B2 | 8/2005 | Nguyen | |
| 7,040,404 | B2 | 5/2006 | Brothers et al. | |
| 7,048,052 | B2 * | 5/2006 | Hackworth et al. | 166/277 |
| 7,121,352 | B2 | 10/2006 | Cook et al. | |
| 7,191,842 | B2 * | 3/2007 | Hackworth et al. | 166/384 |
| 7,216,706 | B2 | 5/2007 | Echols et al. | |
| 7,234,533 | B2 | 6/2007 | Gambier | |
| 7,252,142 | B2 | 8/2007 | Brezinski et al. | |
| 7,264,047 | B2 | 9/2007 | Brezinski et al. | |
| 7,363,975 | B2 | 4/2008 | Loughlin | |
| 7,617,874 | B2 * | 11/2009 | Ocalan | 166/321 |
| 2004/0055758 | A1 | 3/2004 | Brezinski et al. | |

(Continued)

FOREIGN PATENT DOCUMENTS

GB 2415218 A * 12/2005

OTHER PUBLICATIONS

Hackworth, M., et al. "Development and First Application of Bistable Expandable Sand Screen." SPE 84265. SPE Annual Technical Conference and Exhibition held in Denver, Colorado, U.S.A, Oct. 5-8, 2003. Retrieved online on Jan. 30, 2008 from "http://www.reslink.no/download/00084265.pdf" p. 1-14.

(Continued)

*Primary Examiner* — Elizabeth Gitlin

(74) *Attorney, Agent, or Firm* — Cantor Colburn LLP

(57) ABSTRACT

Disclosed herein is a downhole actuator. The actuator includes, a discontinuous tubular being configured to restrict longitudinal expansion while longitudinally contracting in response to radial expansion.

6 Claims, 6 Drawing Sheets

(56) References Cited

U.S. PATENT DOCUMENTS

| | | | |
|---|---|---|---|
| 2005/0023003 | A1 | 2/2005 | Echols et al. |
| 2005/0092485 | A1 | 5/2005 | Brezinski et al. |
| 2006/0037745 | A1 | 2/2006 | Hart et al. |
| 2007/0029080 | A1 | 2/2007 | Moyes |
| 2007/0267824 | A1 | 11/2007 | Baugh et al. |
| 2008/0000646 | A1 | 1/2008 | Thomson |
| 2009/0205840 | A1 | 8/2009 | O'Connor et al. |
| 2009/0229835 | A1 | 9/2009 | Filippov |
| 2010/0078179 | A1 | 4/2010 | Mack |
| 2010/0314111 | A1 | 12/2010 | Karcher et al. |

OTHER PUBLICATIONS

Hackworth, et al. "Development and First Application of Bistable Expandable Sand Screen," Society of Petroleum Engineers: SPE 84265. Oct. 5-8, 2003. 14 pages.

Notification of Transmittal of the International Search Report and the Written Opinion of the International Searching Authority; PCT/US2010/062005; Mailed Jul. 28, 2011, Korean Intellectual Property Office.

* cited by examiner

EXPANDABLE DOWNHOLE ACTUATOR, METHOD OF MAKING AND METHOD OF ACTUATING

BACKGROUND OF THE INVENTION

Monobore expansion systems, used in the downhole hydrocarbon recovery industry, require a seal between an expanded liner and the open hole. Currently, a cementing operation is required after expansion of the liner is complete, to seal the liner to the open hole. This is due to the annular gap between the liner and the open hole, which is too great for the expanded liner to seal to directly even if the liner is encased in an elastomeric member.

Cementing is a time consuming and undesirable process that operators prefer to avoid. Packers that can seal an expanded liner to an open hole require an actuator to actuate them. An actuator that can be run in with the liner and that can actuate a downhole tool, such as a packer, without requiring a separate run-in can save time and money for a well operator. Such an actuator would, therefore, be of interest to the hydrocarbon recovery industry.

BRIEF DESCRIPTION OF THE INVENTION

Disclosed herein is a downhole actuator. The actuator includes, a discontinuous tubular being configured to restrict longitudinal expansion while longitudinally contracting in response to radial expansion.

Further disclosed herein is a downhole tool actuator. The actuator includes, at least two nested tubulars having differing longitudinal contraction properties consequent simultaneous radial expansion, and each of the at least two nested tubulars is in operable communication with the downhole tool such that at least one first portion of the downhole tool moves longitudinally relative to at least one second portion of the downhole tool.

Further disclosed herein is a method of actuating a downhole tool. The method includes, nesting at least two tubulars having different properties of longitudinal contraction in response to radial expansion, fixing at least a portion of the at least two tubulars together, simultaneously radially expanding the at least two tubulars, and actuating the downhole tool with the difference in longitudinal contraction between the at least two tubulars.

Further disclosed herein is a method of making a downhole tool actuator. The method includes, forming a discontinuous tubular having nonsolid walls, including a plurality of load bearing members, a plurality of junctions defined by intersections between the plurality of load bearing members, and at least one tensile support member attached between longitudinally aligned junctions.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
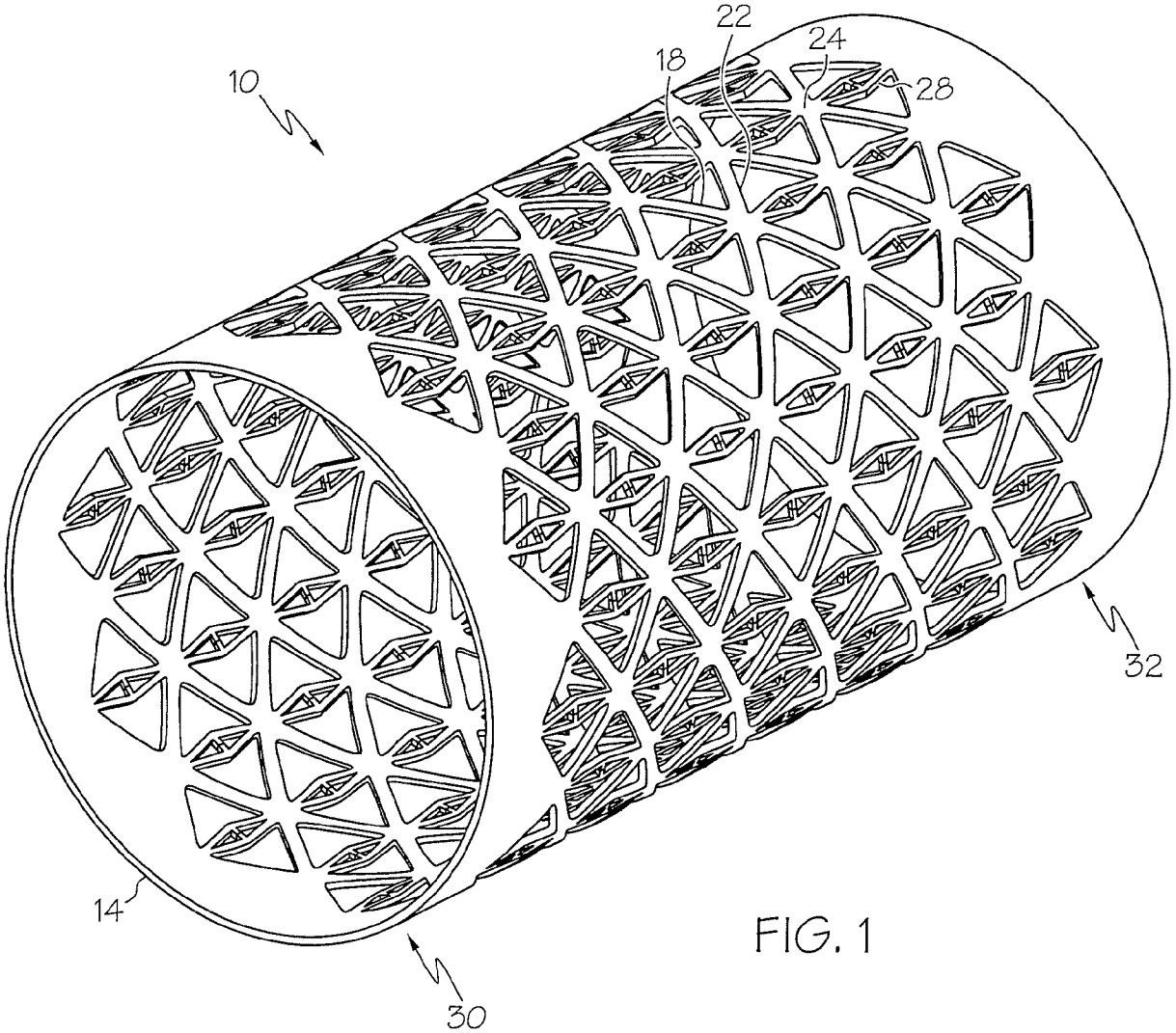
FIG. 1 depicts a perspective view of the downhole tool actuator disclosed herein.

Referring to FIG. 1, an embodiment of the downhole tubular actuator 10 disclosed herein is illustrated. The downhole actuator 10 has a discontinuous tubular shape with web-structured walls 14. The web-structured walls 14 include a plurality load bearing members disclosed herein as a plurality of right-handed helical members 18 and a plurality of left-handed helical members 22. A focus or junction 24 exists at each intersection of the right-handed helical members 18 with the left-handed helical members 22. The web-structured walls 14 of the actuator 10 cause the actuator 10 to deflect in a fashion similar to a Chinese finger trap. As the perimeter of the actuator 10 decreases the length increases, and conversely, when the perimeter of the actuator 10 increases the length decreases, or contracts. It is this relationship of perimeter to longitudinal length and specifically the increase in the perimeter and the accompanying longitudinal contraction that allows the actuator 10 to actuate a downhole tool. The actuator 10, however, differs from a Chinese finger trap in that the actuator 10 has a plurality of tensile support members 28 that limit the longitudinal length of the actuator 10. The tensile support members 28 are attached between adjacent longitudinally aligned foci or junctions 24. The tensile support members 28 allow the actuator 10 to apply a tensile force therethrough. As such, the support members 28, in an area that is not being radially expanded, transmit tension generated from a portion of the actuator 10 that is radially expanding and longitudinally contracting. If the tensile support members 28 were not present, the portion of the actuator 10 that is not longitudinally contracting would longitudinally expand (and simultaneously radially contract), in response to the longitudinal tension supplied thereto by the portion of the actuator 10 that is longitudinally contracting. The tensile support members 28, therefore, permit the actuator 10 to be radially expanded in a longitudinally progressive manner. For example, the actuator 10 can be radially expanded starting at a first end 30 and progressing to a second end 32, while providing longitudinal tension and movement of the second end 32 toward the first end 30 throughout the full expansion process of the actuator 10.

Figure 2A:
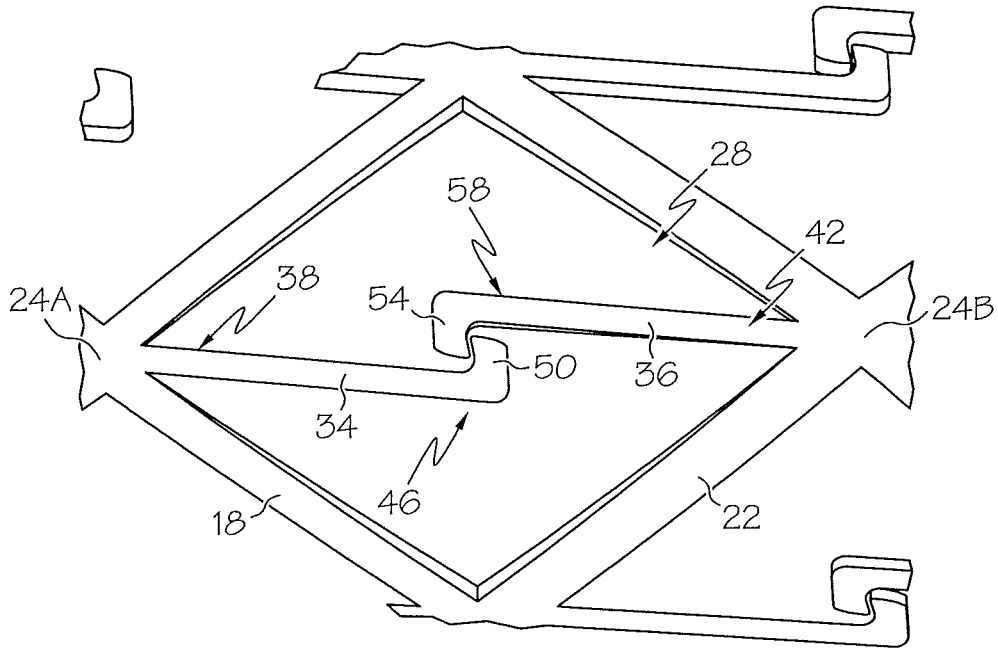
FIGS. 2A-2D depict alternate embodiments of tensile support members disclosed herein.

Referring to FIGS. 2A-2D, optional embodiments of the tensile support member 28 are illustrated. The shapes of these embodiments are configured to axially contract in greater amounts in response to radial expansion than, for example, tubulars without such shapes. Several variables affect the relationship of axial compression to radial expansion. For example, pairs of the right-handed helical members 18 and the left-handed helical members 22 create diamond shapes with specific angles between the members 18, 22. In FIG. 2A the tensile support member 28 is constructed from a first latching member 34 and a second latching member 36. The first latching member 34 is attached to the junction 24A at a first end 38 similarly the second latching member 36 is attached to the junction 24B at a first end 42 thereof. The first latching member 34 has a second end 46, opposite the first end 38 with at least one tooth 50 thereon. The at least one tooth 50 is engagable with at least one tooth 54 on a second end 58 of the second latching member 36. The junction 24A is in longitudinal alignment with the junction 24B in such a way that latching engagement of the tooth 50 with the tooth 54 prevents the junctions 24A and 24B from moving longitudinally away from one another, thereby allowing the actuator 10 to transmit tension therethrough. The orientation of the latching members 34, 36 and the teeth 50, 54 thereon, however, allows the junctions 24A and 24B to move closer together without obstructing such motion. This relative motion of the junctions 24A and 24B is necessary for longitudinal contraction of the actuator 10 during actuation thereof.

Figure 2B:
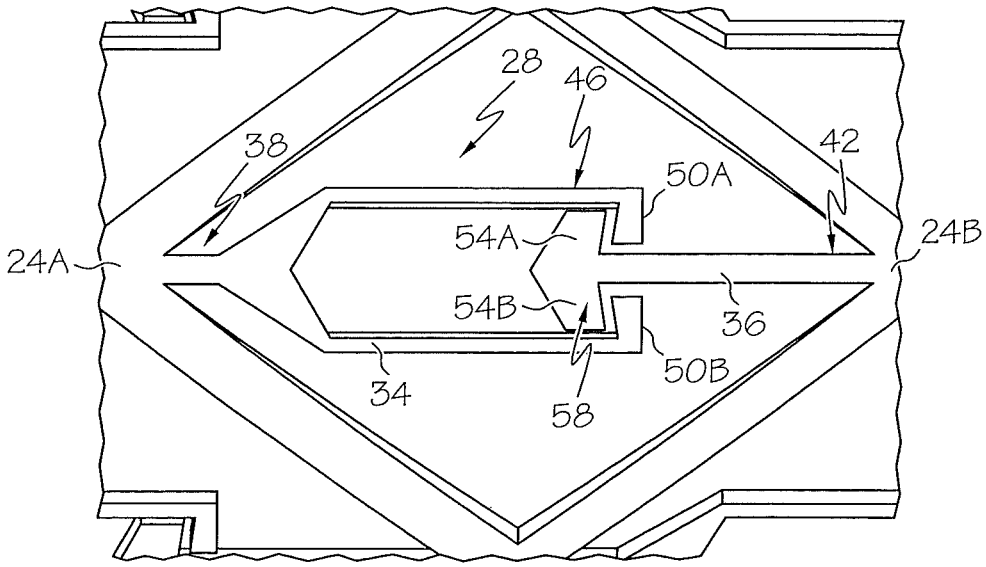

Referring to FIG. 2B, an alternate embodiment of the tensile support member 28 is illustrated. The tensile support member 28 of this embodiment is constructed from a first latching member 34 and a second latching member 36. The first latching member 34 is attached to the junction 24A at a first end 38 similarly the second latching member 36 is attached to the junction 24B at a first end 42 thereof. The first latching member 34 has a second end 46, opposite the first end 38 with teeth 50A and 50B thereon. The teeth 50A and 50B are engagable with teeth 54A and 54B, respectively, on a second end 58 of the second latching member 36. The junction 24A is in longitudinal alignment with the junction 24B in such a way that latching engagement of the teeth 50A, 50B with the teeth 54A, 54B prevents the junctions 24A and 24B from moving longitudinally away from one another thereby allowing the actuator 10 to transmit tension therethrough. The orientation of the latching members 34, 36 and the teeth 50A, 50B, 54A, 54B thereon, however, allows the junctions 24A and 24B to move closer together without obstructing such motion. This relative motion of the junctions 24A and 24B is necessary for longitudinal contraction of the actuator 10 during actuation thereof.

Figure 2C:
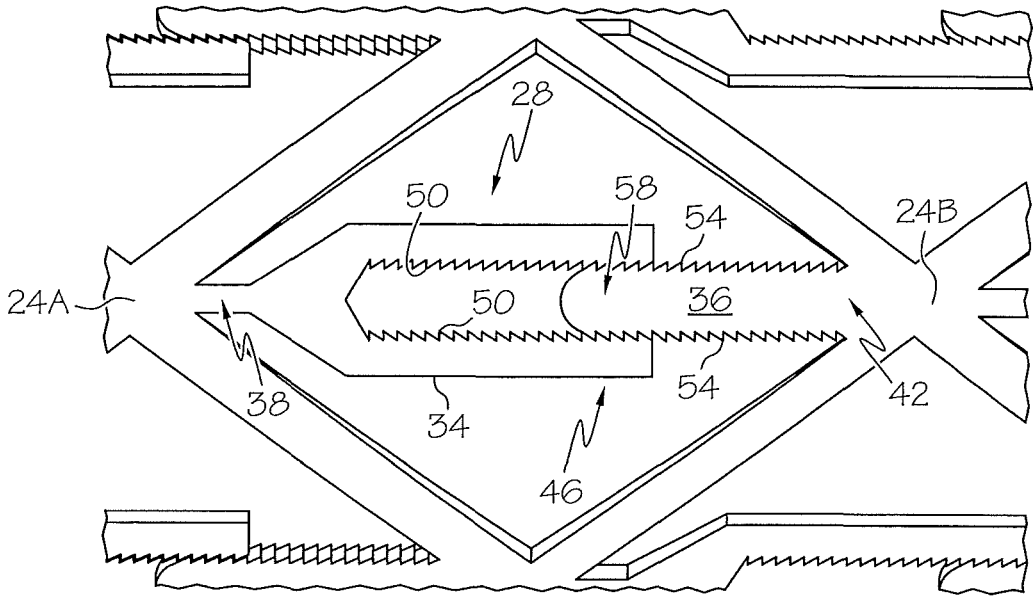

Referring to FIG. 2C, an alternate embodiment of the tensile support member 28 is illustrated. The tensile support member 28 of this embodiment is constructed from a first latching member 34 and a second latching member 36. The first latching member 34 is attached to the junction 24A at a first end 38. Similarly, the second latching member 36 is attached to the junction 24B at a first end 42 thereof. The first latching member 34 has a second end 46, opposite the first end 38 with a plurality of teeth 50 thereon. The teeth 50 are engagable with a plurality of teeth 54 on a second end 58 of the second latching member 36. The junction 24A is in longitudinal alignment with the junction 24B in such a way that latching engagement of the teeth 50 with the teeth 54 prevents the junctions 24A and 24B from moving longitudinally away from one another, thereby allowing the actuator 10 to transmit tension therethrough. The orientation of the latching members 34, 36 and the teeth 50, 54 thereon, however, allows the junctions 24A and 24B to move closer together without obstructing such motion. This relative motion of the junctions 24A and 24B is necessary for longitudinal contraction of the actuator 10 during actuation thereof.

Figure 2D:
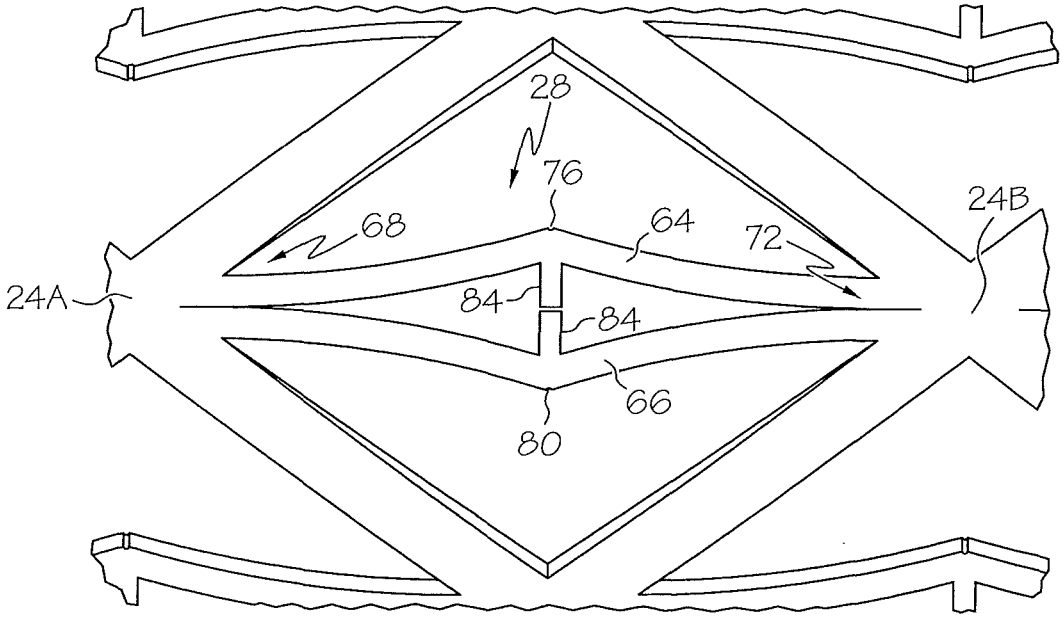

Referring to FIG. 2D, an alternate embodiment of the tensile support member 28 is illustrated. The tensile support member 28 of this embodiment is constructed from a first deformable member 64 and a second deformable member 66. The first deformable member 64 is attached to the junction 24A at a first end 68 and to the junction 24B at a second end 72. Similarly, the second deformable member 66 is attached to the junction 24A at the first end 68 and to the junction 24B at the second end 72. The first deformable member 64 has a central portion 76 that is offset from a longitudinal line that connects the junctions 24A and 24B. This offset promotes buckling of the first deformable member 64 in response to compressive loads being applied thereto. Similarly, the second deformable member 66 has a central portion 80 that is offset from a longitudinal line that connects the junctions 24A and 24B. This offset promotes buckling of the second deformable member 66 in response to compressive loads being applied thereto. The buckling of the deformable members 64, 66 allows the junctions 24A and 24B to move closer together in response to longitudinal contraction of the actuator 10 as the actuator 10 is expanded radially. The deformable members 64, 66 each have a travel limiter 84 that protrudes from the central portions 76, 80 toward the opposite deformable member 64, 66. The travel limiters 84, by contacting one another, prevent offsets of the central portions 76, 80 from becoming longitudinally aligned in response to longitudinal tension applied thereacross, thereby allowing the tensile support member 28, of this embodiment, to support tensile loads therethrough.

Embodiments of the actuator 10 disclosed in FIGS. 2A-2D have the details of the web-structured walls 14 constructed of a single piece of material with the helical members 18, 22 and the tensile support members 28 formed from the wall. Such forming out of the wall of a continuous single piece tubular can be done with a laser, for example, that cuts through the walls. Alternate embodiments, however, can have the web-structured walls 14 constructed of separate components. For example, the actuator 10 could be completely fabricated from cables that are attached to one another at the points of intersection. Alternately, embodiments could be a hybrid between a one piece design and cables. In such an embodiment, for example, the helical members 18, 22 could be formed from a single piece of material, while the tensile support members 28 could be cables that are welded between longitudinally aligned junctions.

Figure 3:
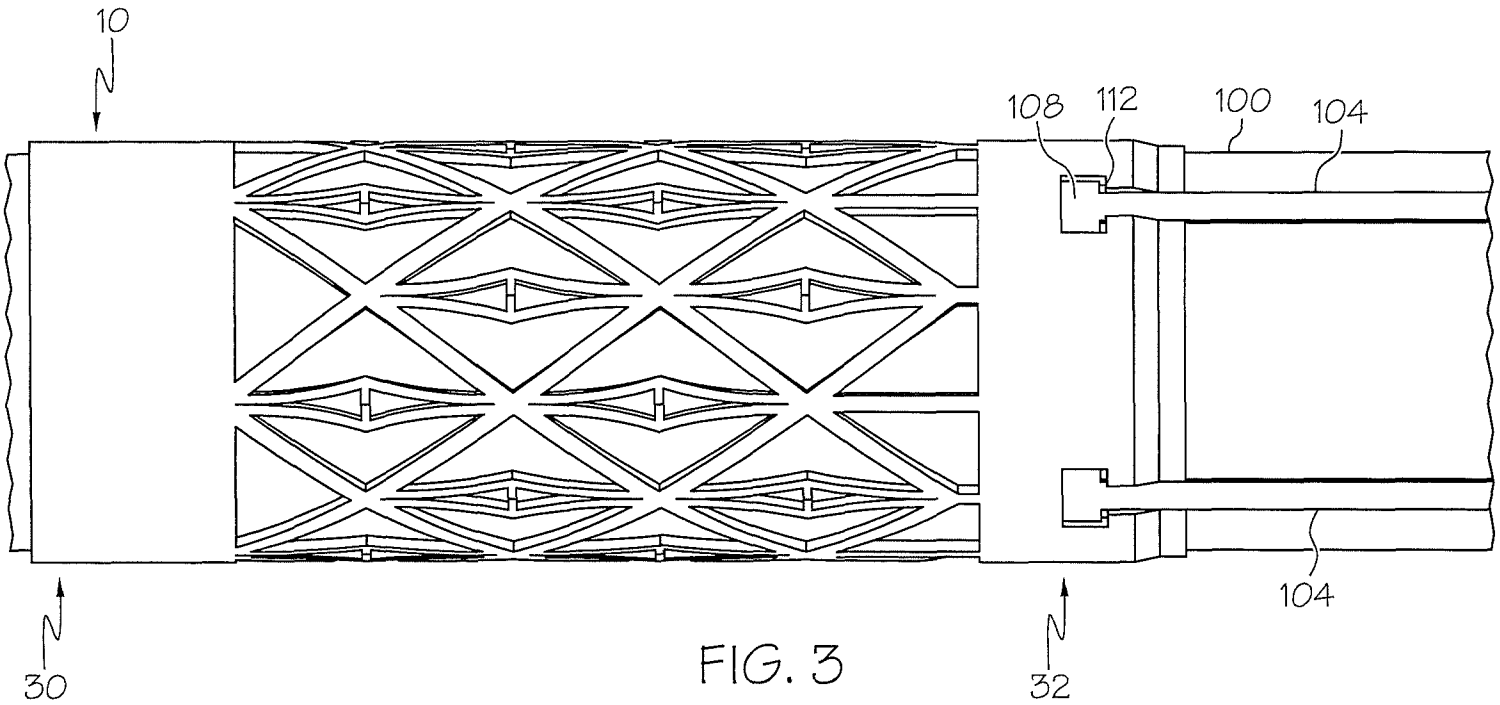
FIG. 3 depicts a partial side view of the downhole tool actuator disclosed herein connected to a downhole tool.

Referring to FIG. 3, an embodiment having the actuator 10 attached to an expandable tubular 100 is illustrated. The first end 30, on an uphole end of the actuator 10 in this embodiment, is attached to the expandable tubular 100 by a process such as welding or threadable engagement, for example. It should be noted that the first end 30 in alternate embodiments could instead be on a downhole end of the actuator 10 and as such would permit similar operation as disclosed herein except with the actuation direction reversed. The second end 32 of the actuator 10 is not attached to the expandable tubular 100 and as such is free to slide relative to the expandable tubular 100. A plurality of actuating rods 104 are connected to the second end 32 by heads 108 that engage with receiving slots 112 in the actuator 10. The actuating rods 104 are positioned longitudinally along the expandable tubular 100 beyond the actuator 10 to a downhole tool 116 to be actuated as will be disclosed below.

Figure 4:
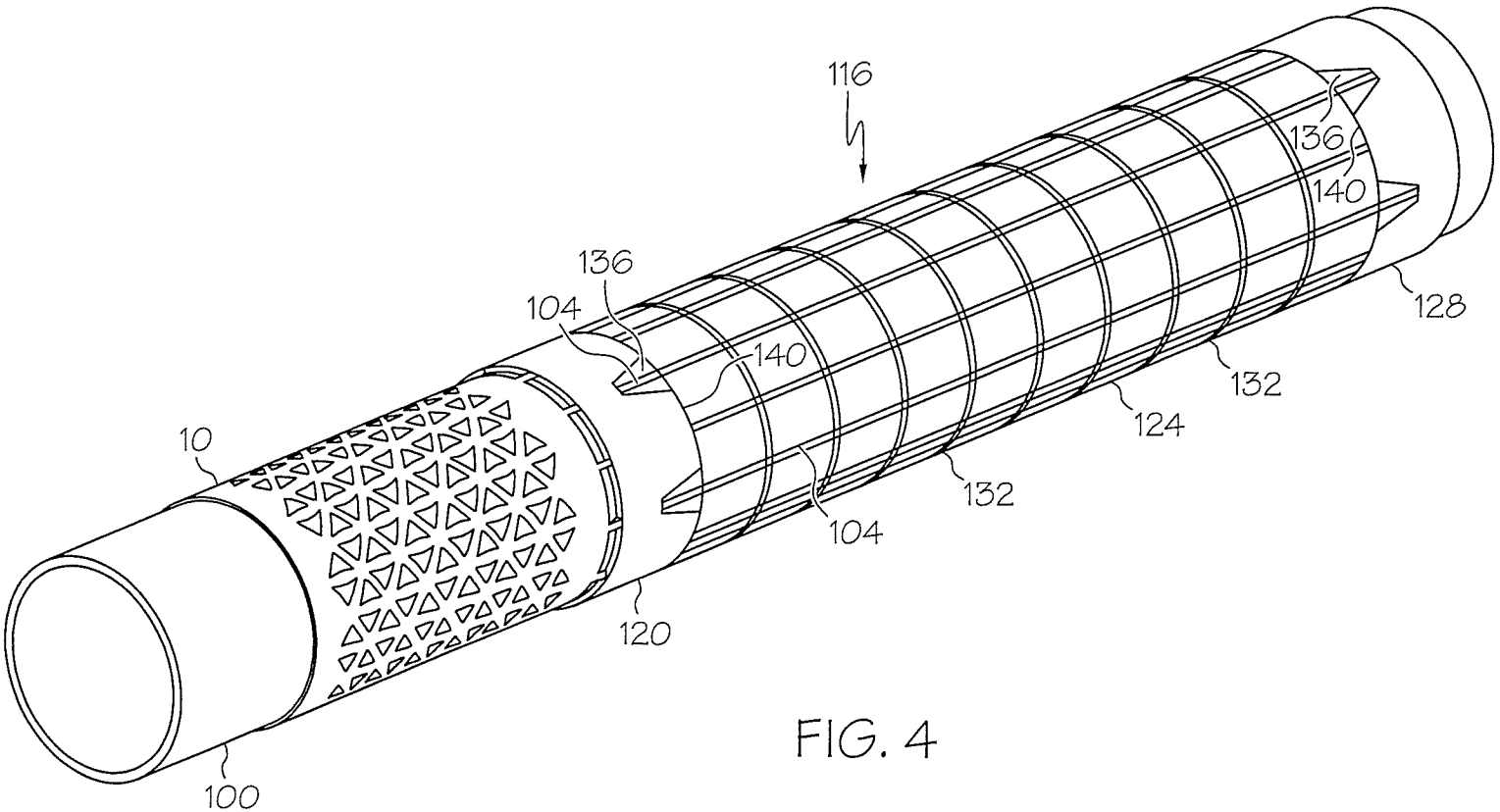
FIG. 4 depicts a full perspective view of the downhole tool actuator and downhole tool of FIG. 3.

Referring to FIG. 4, the actuator 10, the expandable tubular 100 and the actuating rods 104 are shown in operable communication with the downhole tool 116, disclosed in this embodiment as a packer. The packer 116 includes an anchoring ring 120, an elastomeric element 124 and a back-up ring 128. The anchoring ring 120 is fixedly attached to the expandable tubular 100 and has longitudinal holes that are slidably engaged with the actuating rods 104. The elastomeric member 124 is slidably engaged with the expandable tubular 100 and also has longitudinal holes therein that are slidably engaged with the actuating rods 104. The elastomeric member 124 in FIG. 4 is shown as semitransparent to allow the routing of the rods 104 within the elastomeric member 124 to be visible. The actuating rods 104 are attached to the back-up ring 128 that is slidably engaged about the expandable tubular 100. As will be described next, the foregoing structure allows the actuator 10 to actuate the packer 116 in response to radial expansion of the actuator 10.

A swaging tool (not shown) entering the expandable tubular 100 from the uphole end, in this embodiment, and moving in a downhole direction, as shown in FIG. 4, will progressively radial expand the expandable tubular 100 and the actuator 10 as it moves downhole. As the actuator 10 is radially expanded its longitudinal length shortens more than the longitudinal length of the expandable tubular 100. Note: the expandable tubular 100 will also shorten longitudinally in response to radial expansion; however, without having web-structured walls, the longitudinal contraction of the expandable tubular 100 will be less than that of the actuator 10. The longitudinal contraction of the actuator 10 is transmitted through the tensile support members 28 and to the actuating rods 104, thus causing the actuating rods 104 to move in an uphole direction relative to the expandable tubular 100 and the anchoring ring 120. Uphole movement of the actuating rods 104 causes the back-up ring 128 to move in the uphole direction as well thereby compressing the elastomeric member 124 between the anchoring ring 120 and the back-up ring. Compression of the elastomeric member 124 causes the elastomeric member 124 to buckle. The buckling of the elastomeric member 124 causes the elastomeric member 124 simultaneously expand radially outwardly and radially inwardly to seal to both an outer dimension of the expandable tubular 100 as well as to the inner surface 130 of a casing, wellbore or other tubular (see FIG. 5) within which the packer 116 is positioned.

The elastomeric member 124 may include optional radial grooves 132 to promote buckling in response to longitudinal compression. Additionally, slots 136 may be incorporated into the rings 120, 128 forming petals 140 that can deform outwardly to assure that the elastomeric member 124 does not slide over the rings 120, 128.

The relative longitudinal lengths of the nondeformed elastomeric member 124 and the actuator 10 can be set to create whatever amount of longitudinal compression of the elastomeric member 124 is desired. This point is made clear by the following extreme example: by making the actuator 10 very long in comparison to the longitudinal length of the elastomeric member 124 the longitudinal travel of the actuating rods 104 can be equal to the total length of the elastomeric member 124 thereby generating 100% compression. Although this example is not practical, it illustrates the flexibility in range of compression that can be generated.

Figure 5:
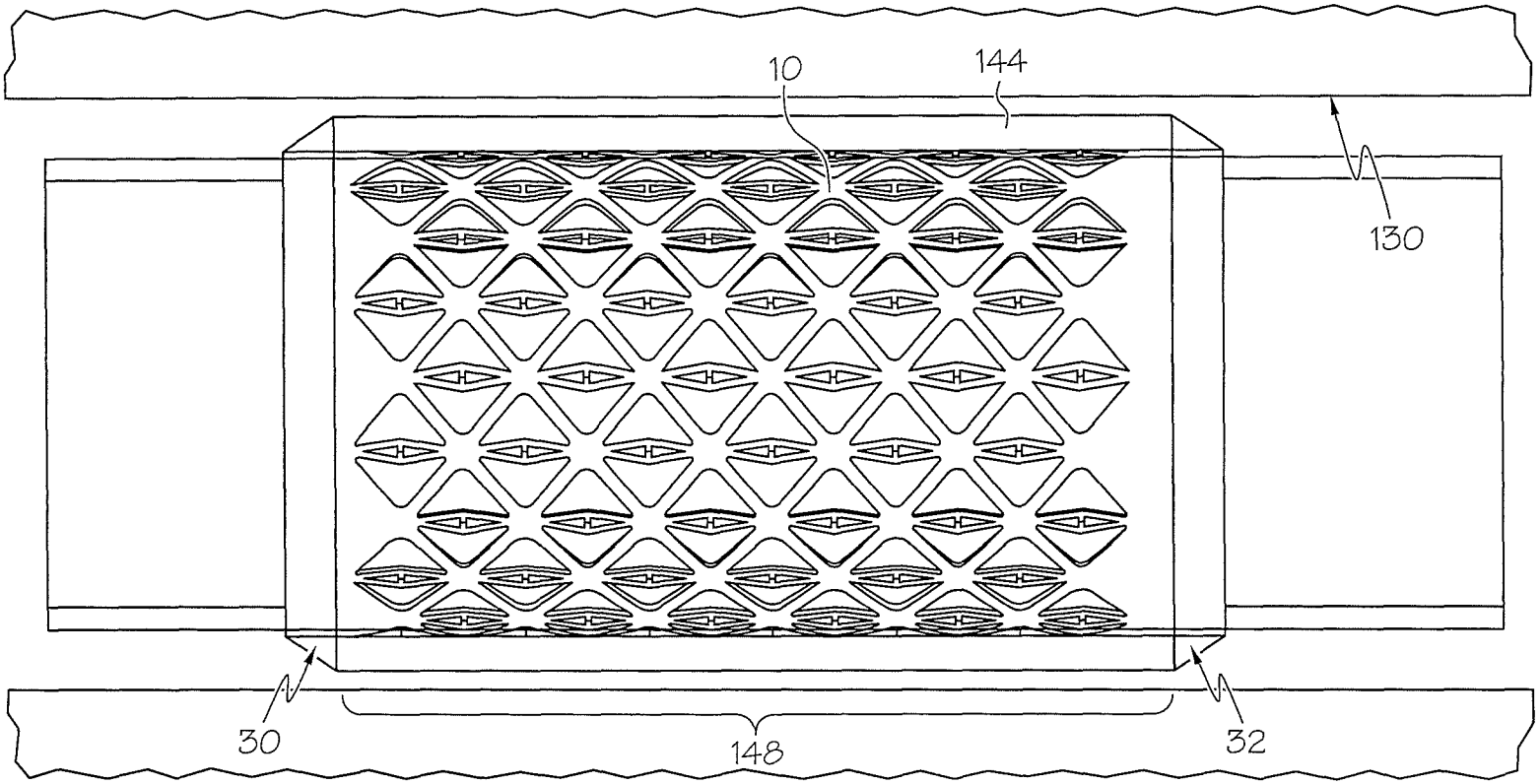
FIG. 5 depicts an alternate embodiment of the downhole tool actuator disclosed herein.

Referring to FIG. 5, an alternate embodiment could be used alone in combination with the embodiment disclosed in FIGS. 3 and 4. The embodiment of FIG. 5 includes an elastomeric sleeve 144 (shown semitransparent) surrounding the actuator 10. The elastomeric sleeve 144 is attached to the first end 30 and the second end 32 while being free to slide relative to the remainder of the actuator 10 throughout a central portion 148 thereof. As the actuator 10 is radially expanded, the elastomeric sleeve 144 will also radially expand since the elastomeric sleeve 144 radially surrounds the actuator 10. The elastomeric sleeve 144, in addition to increasing radially, also increases in radial thickness. The radial thickness increase is due to the longitudinal compression of the elastomeric sleeve 144 and the bunching effect imparted thereto in response to the ends 30 and 32 moving closer together as the length of the actuator 10 is contracted. This bunching causes sealing forces to form in the elastomeric sleeve 144 between an outer dimension of the actuator and the inner surface 130. This embodiment can act alone as a packer creating a desired seal or in combination with a longitudinally remote packer, for example, as described in the above embodiments.

Although the embodiments disclosed herein are illustrated as actuating packers, alternate embodiments could actuate alternate downhole tools, such as, valves, centralizers, slips (for liner hangers) and anchor teeth (for wellbore anchoring), for example. Actuation of nearly any downhole tool could be carried out with embodiments of the invention.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole actuator comprising:

a discontinuous tubular having a substantially consistent and repeating structure over a longitudinal extent, the longitudinal extent having at least both a first section and a second section exhibiting the repeating structure, the discontinuous tubular being configured to restrict longitudinal expansion of the first section while longitudinally contracting the second section in response to radial expansion of the second section; and an elastomeric sleeve attached to at least two portions of the discontinuous tubular such that longitudinal contraction of the discontinuous tubular cause bunching of the elastomeric sleeve.

2. A downhole tool actuator, comprising:

at least two nested tubulars having differing longitudinal contraction properties consequent simultaneous radial expansion, and each of the at least two nested tubulars being in operable communication with a downhole tool such that at least one first portion of the downhole tool moves longitudinally relative to at least one second portion of the downhole tool in response to both of the at least two nested tubulars being radially expanded at least one of the tubulars having substantially consistent discontinuous structure throughout both a first section and a second section, the substantially consistent discontinuous structure being configured to restrict longitudinal expansion of the first section while longitudinally contracting the second section in response to radial expansion of the second section.

3. The downhole actuator of claim 2, wherein the at least two nested tubulars are longitudinally attached together at at least one location.

4. The downhole actuator of claim 2, wherein the substantially consistent discontinuous structure includes web-structured walls.

5. A method of actuating a downhole tool, comprising:

nesting at least two tubulars having different properties of longitudinal contraction in response to radial expansion;

fixing at least a portion of the at least two tubulars together;

simultaneously radially expanding the at least two tubulars;

restricting longitudinal expansion in a discontinuously walled section of at least one of the two tubulars that is not being radially expanded; and actuating the downhole tool with the difference in longitudinal contraction between the at least two tubulars.

6. The method of actuating a downhole tool of claim 5, wherein the fixing at least a portion attaches the at least two tubulars at an uphole portion of the at least two tubulars and swaging is performed in a downhole direction.

* * * * *